US007317365B2

(12) United States Patent
Rosenberg et al.

(10) Patent No.: US 7,317,365 B2
(45) Date of Patent: Jan. 8, 2008

(54) BANDPASS FILTER HAVING PARALLEL SIGNAL PATHS

(75) Inventors: Uwe Rosenberg, Backnang (DE); Smain Amari, Kingston (CA)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/505,716

(22) PCT Filed: Feb. 28, 2003

(86) PCT No.: PCT/IB03/01061

§ 371 (c)(1),
(2), (4) Date: May 11, 2005

(87) PCT Pub. No.: WO03/073606

PCT Pub. Date: Sep. 4, 2003

(65) Prior Publication Data

US 2005/0212622 A1 Sep. 29, 2005

(30) Foreign Application Priority Data

Feb. 28, 2002 (DE) ..... 102 08 666

(51) Int. Cl.
*H01P 1/20* (2006.01)

(52) U.S. Cl. ..... 333/202; 333/219; 333/100; 333/129; 333/212

(58) Field of Classification Search ..... None
See application file for complete search history.

(56) References Cited

U.S. PATENT DOCUMENTS

| | | | | |
|---|---|---|---|---|
| 3,345,589 | A * | 10/1967 | Di Piazza | 333/204 |
| 4,477,785 | A * | 10/1984 | Atia | 333/202 |
| 4,725,797 | A * | 2/1988 | Thompson et al. | 333/212 |
| 5,097,236 | A * | 3/1992 | Wakino et al. | 333/175 |
| 5,699,029 | A | 12/1997 | Young et al. | |
| 6,337,610 | B1 * | 1/2002 | Williams et al. | 333/202 |

FOREIGN PATENT DOCUMENTS

| | | |
|---|---|---|
| EP | 0 541 284 A1 | 5/1993 |
| EP | 1 148 576 A2 | 10/2001 |
| GB | 1062269 | 3/1967 |
| JP | 62097404 | 5/1987 |

* cited by examiner

*Primary Examiner*—Benny Lee
*Assistant Examiner*—Kimberly E Glenn

(57) ABSTRACT

A bandpass filter comprises a number of resonators which are arranged between an input and an output of the filter and which are interconnected to form at least two main signal paths that lead from the input to the output. The at least two main signal paths have overlapping passbands and are connected to the input and/or output via different resonators.

2 Claims, 6 Drawing Sheets

| | S | 1 | 2 | 3 | 4 | L |
|---|---|---|---|---|---|---|
| S | | 1,0345 | | | | |
| 1 | 1,0345 | | 0,9194 | | -0,0166 | |
| 2 | | 0.9194 | | 0,7087 | | |
| 3 | | | 0,7087 | | 0,9104 | |
| 4 | | -0,0166 | | 0,9104 | | 1,0345 |
| L | | | | | 1,0345 | |

| | S | 1 | 2 | 3 | 4 | L |
|---|---|---|---|---|---|---|
| S | | 0,5798 | | 0,8559 | | |
| 1 | 0,5798 | | 1,3216 | | | |
| 2 | | 1,3216 | | | | 0,5798 |
| 3 | 0,8559 | | | | -0,6321 | |
| 4 | | | | -0,6321 | | 0,8559 |
| L | | | 0,5798 | | 0,8559 | |

BANDPASS FILTER HAVING PARALLEL SIGNAL PATHS

The present invention concerns a band pass filter for an electric or electromagnetic signal, especially for a high-frequency signal. Such filters play an important role in the design of components for modern telecommunications systems. The requirements that are generally imposed on such filters include steep filter flanks, high non-pass attenuation, uniform phase shift in the pass band region, etc. A distinction is made between different filter types, like Cauer, Tschebyscheff, Butterworth or Bessel filters, each of which satisfies one or more of these requirements particularly well.

A common feature of all these filters is that they are constructed from one or more resonators. In the simplest case of a filter with several resonators, the individual resonators are connected in series, so that a single signal path exists through the filter, on which a signal of all resonators pass through according to the sequence. The flank steepness, non-pass attenuation, etc., attainable with such an arrangement of resonators, are established, among other things, by the number of resonators.

Ordinary filter synthesis techniques additionally allow for the possibility, in addition to a pure series circuit, of connecting individual, not directly adjacent resonators of the filter to each other, in order to produce overlapping of signal contributions in one resonator, which can lead to zero setting of the transmission function of the filter during finite arguments in the complex number plane. Filters synthesized with such methods always have a main signal path that runs through all the resonators of the filter and, in addition to the main signal path, one or more secondary signal paths that run from the input to the output of the filter via at least one coupling between non-adjacent resonators on the main signal path, and therefore have a smaller number of resonators in the main signal path.

Band pass filters are known from U.S. Pat. No. 6,337,610 B1 having two main signal paths, i.e., two first signal paths, in which, unlike the secondary signal paths of the ordinary filter structures, each has a second signal path that passes through all the resonators of the first path in the same sequence, and one or more additional resonators between at least two directly consecutive resonators on the first path. These main signal paths of these known filters each have a common input or output resonator connected to the input or output.

Practical implementation of such filters is connected with significant demands and these demands are greater, the larger the number of resonators n is, the more resonators are connected in series, and the more numerous are the secondary signal paths. Tuning conducted on a resonator can require corrections on adjacent resonators, those of the main signal path, and also possibly secondary signal paths, starting from the corresponding resonator. In the filters known from U.S. Pat. No. 6,337,610 B1, coupling between main signal paths is also possible via the common input and output resonators.

The task of the present invention is to provide a band pass filter, whose structure permits a simpler, faster and therefore more cost-effective filter implementation than the previous filter structures.

The filter according to the invention is characterized by the fact that the several main signal paths that run from its input to its output have no common resonators at the input and/or output, i.e., they are connected via different resonators to the input and/or output. A change made on one of the main signal paths can influence the behavior of the other main signal path, at best, via a single common resonator at the input or output of the filter, and is therefore easy to handle in a simulation.

The main signal paths preferably have no common resonators either at the input or output of the filter. Mutual influencing of the main signal paths is then ruled out and they can be optimized fully independently of each other.

None of the main signal paths of the filter according to the invention runs through all n resonators of the filter, so that a transmission function can be assigned to each of these main signal paths, which corresponds to a smaller wave number than the total number n of resonators. Amazingly, by overlapping of these transmission functions, a total transmission function of the filter according to the invention that corresponds to an ordinary filter with a single main signal path through all end resonators is obtained. The advantage of the filter structure according to the invention, however, is that its main signal paths, because of the smaller wave number, can be implemented at lower cost that those of the ordinary filter, and that changes that are made during optimization on a resonator pertaining to only one of the main signal paths essentially affect only the transmission function of this main signal path and leave the other main signal paths uninfluenced. The problem of implementing an n-pole filter can then be broken down into implementation of several partial filters corresponding to a main signal path with a smaller wave number, these partial filters each having free parameters that can be optimized without changing the transmission functions of the other partial filters.

The filter structure according to the invention is applicable to a number of filter types that are described below in conjunction with the figures, with reference to practical examples.

FIGS. 1*a*, 1*b* show examples of structures of a filter according to the invention with four resonators;

Figure 1A:
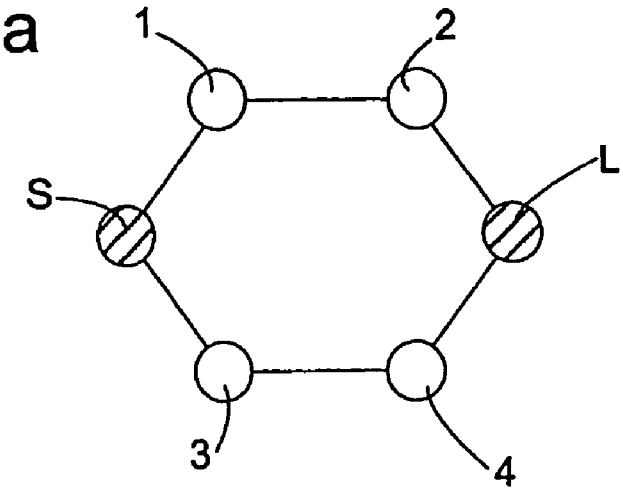
Figure 2:
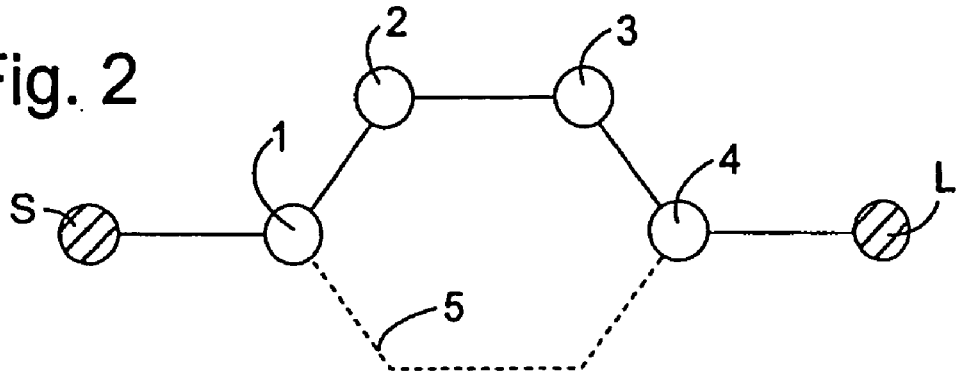
FIG. 2 shows, for comparison, the structure of an ordinary filter with four resonators.
Figures 3, 4A, 4B:
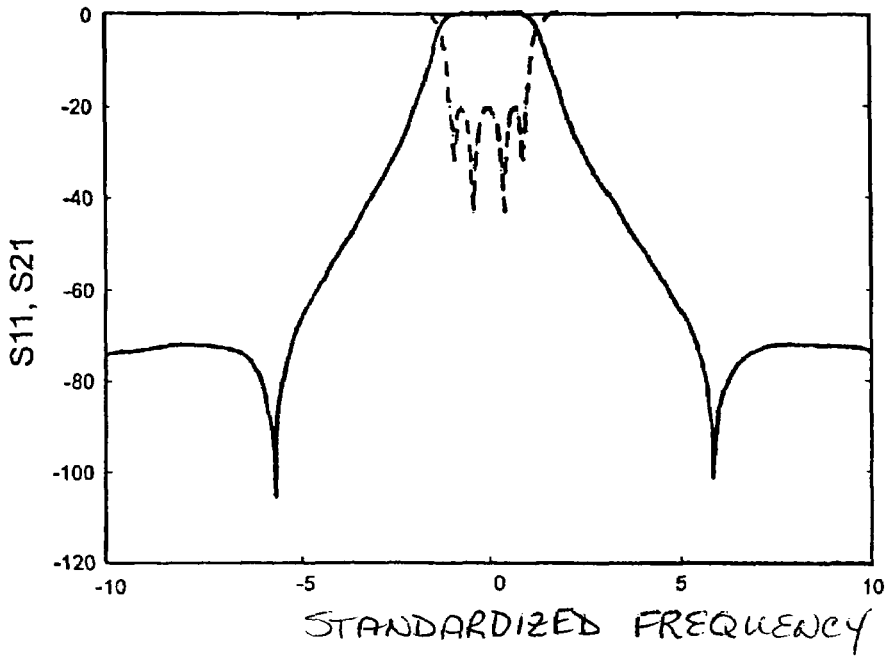
FIG. 3 shows the transmission and reflection function of a filter that can be implemented with the structure according to FIG. 1*a* or according to FIG. 2.

FIG. 4*a*, 4*b* show coupling matrices for implementation of the filter with the behavior depicted in FIG. 2 by means of the structure of FIG. 2*a* or FIG. 1*a;*

Figure 5:
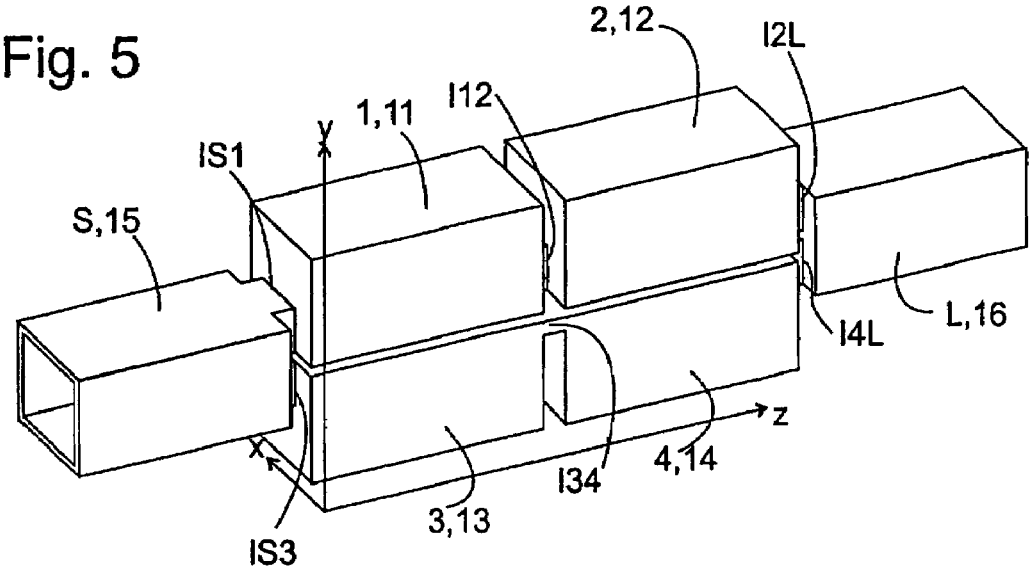
Figure 6:
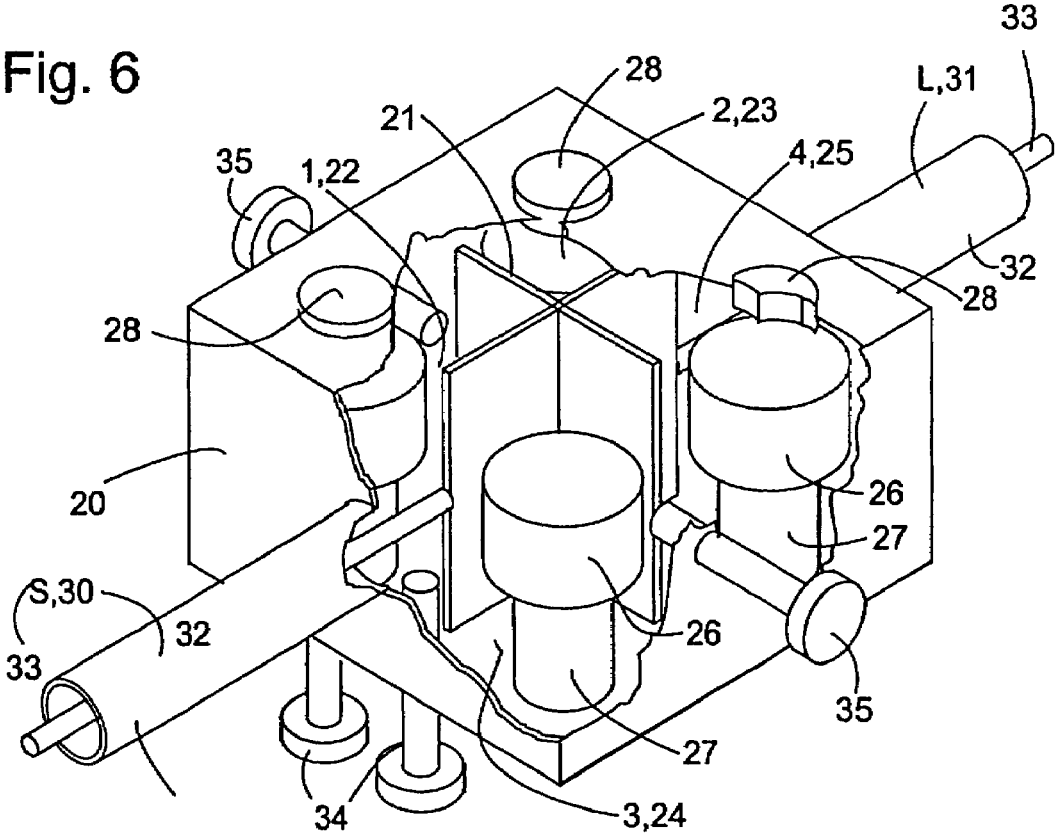
Figure 7A:
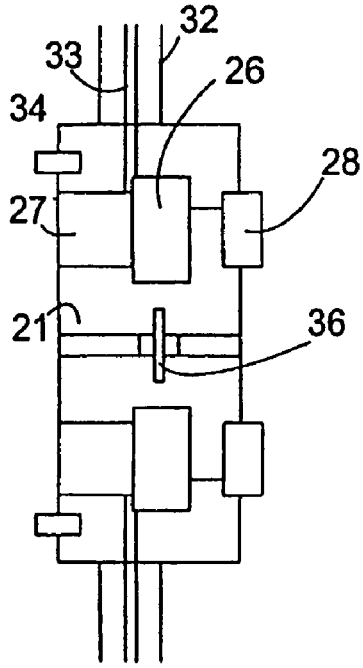
Figure 7B:
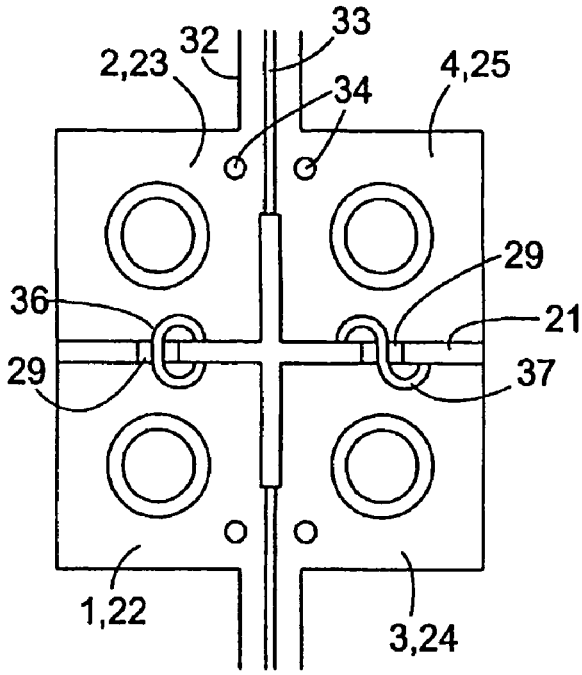
Figure 8A:
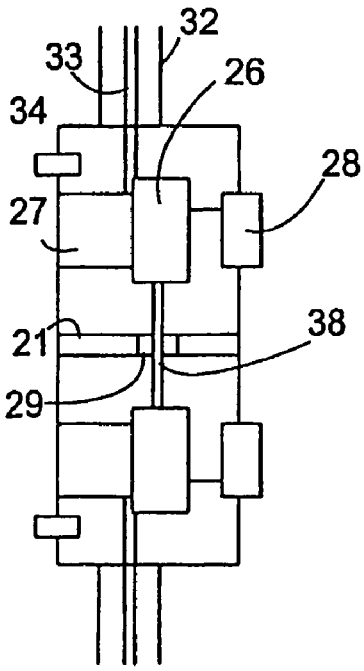
Figure 9:
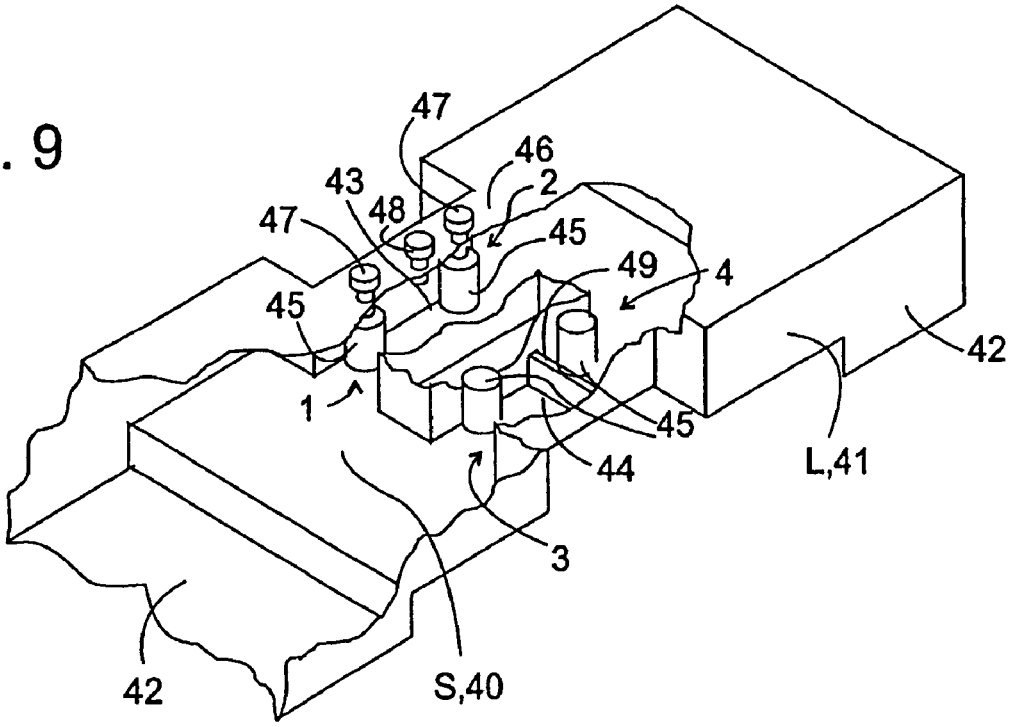
Figure 10:
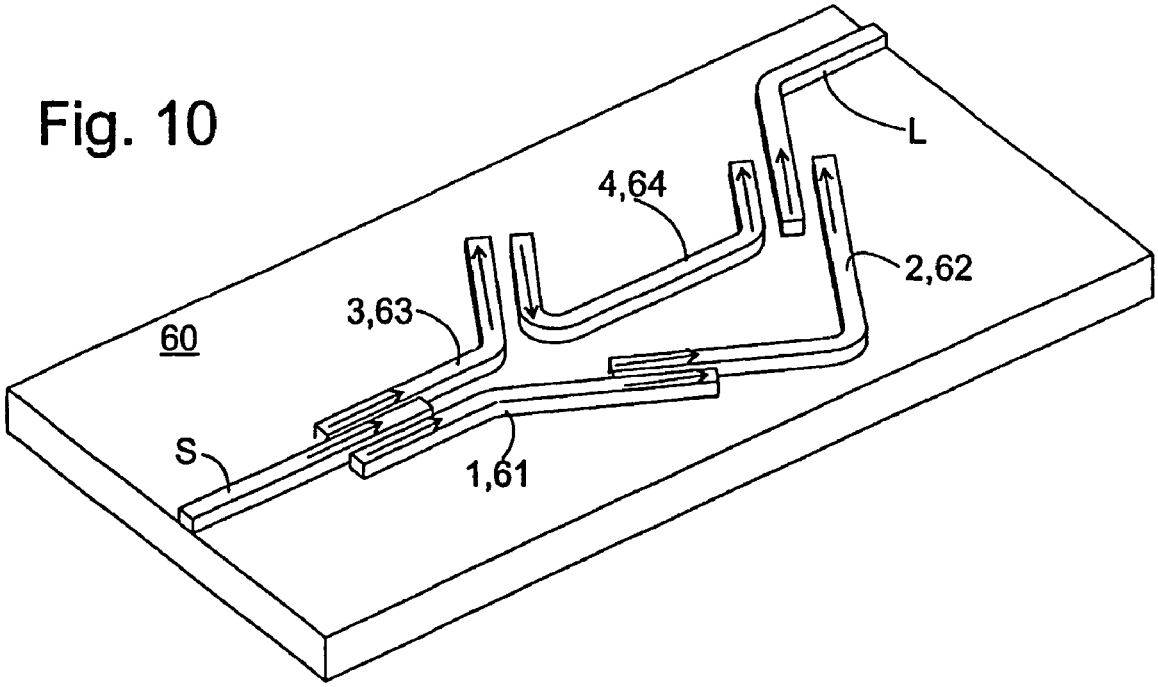

FIG. 5 shows a schematic perspective of a filter according to the invention with rectangular cavity resonators;

FIG. 6 shows a perspective, partially cutaway view of the filter with four dielectrically loaded resonators;

FIGS. 7*a*, 7*b* show two sections through a first modification of the filter from FIG. 6;

FIGS. 8*a, b* show two sections through a second modification of a filter from FIG. 6;

FIG. 9 shows a perspective, partially cutaway view of a filter with four coaxial resonators;

FIG. 10 shows a view of a filter with four stripline resonators and the structure according to FIG. 1*a;*

Figure 11:
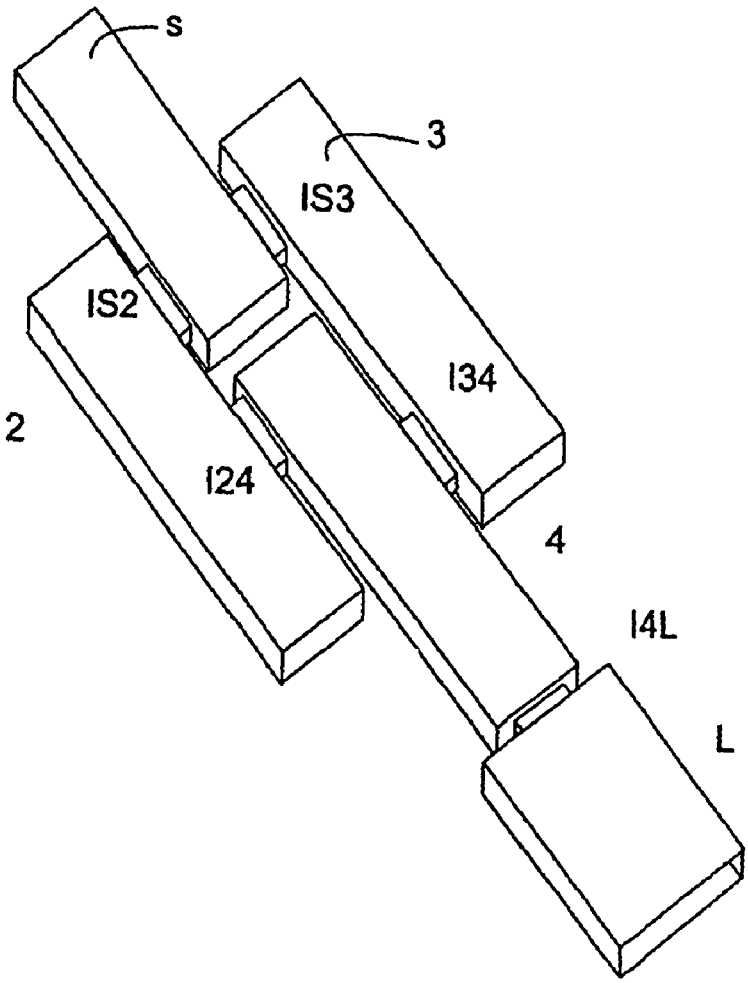
Figure 12:
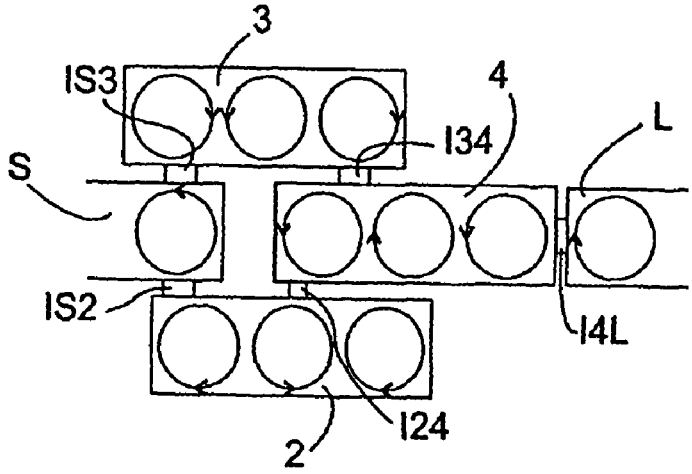

FIG. 11 shows a schematic perspective view of a filter with a cavity resonator that uses higher wave types;

FIG. 12 shows a schematic view of the magnetic fields in the resonators of the filter from FIG. 10

Figure 1B:
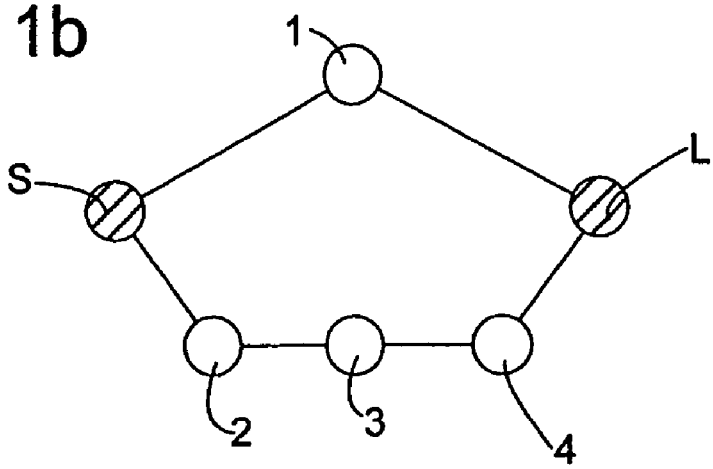

FIGS. 1*a* to 1*b* each show a filter structure according to the invention in comparison with the ordinary filter structure of FIG. 2.

In the ordinary filter structure, a signal path extends from input S of the filter to output L, passing through all four resonators 1 to 4 of the filter in series. The resonators 1 to 4 of the main signal path are strongly coupled to each other, so that the comparatively weak direct coupling of the resonators 1 and 4 to each other via the secondary signal path 5, depicted with a dashed line, during calculation of the behavior of the filter can be treated as a disturbance in the filter, characterized essentially by the main signal path.

In contrast to this, in the filters of FIGS. 1*a*, 1*b*, there are no main signal paths, to which all the resonators belong. Instead, there are two main signal paths that are formed, in the case of FIG. 1*a*, by resonators 1, 2 or 3, 4 and, in the case of FIG. 1*b*, by resonator 1 or resonators 2 to 4.

Since the main signal paths, in the case of FIGS. 1*a*, 1*b*, run from the input S to the output L of the filter without any interaction with each other, such a filter can be developed by initially calculating the couplings into the individual main signal paths as a function of a desired transmission function of the entire filter, and then implementing the individual main signal paths completely independently of each other.

FIG. 3 shows the trend of the transmission characteristic, shown as a solid curve 8, and the reflection characteristic, shown as a dashed curve 9, of a filter with four resonators. The characters 8, 9 are attainable with a filter having the structure depicted in FIG. 2 by means of the matrix of coupling coefficients depicted in FIG. 4*a*. The elements of the matrix that are situated on the positions directly adjacent to the main diagonals correspond to the coupling coefficients of the main signal path. Since all these positions have values different from zero, the filter has precisely one main signal path. All elements of the matrix that are not situated on either of these positions nor on the main diagonals represent overcouplings of secondary signal paths. In FIG. 4*a*, these are the elements 14 and 41, which describe a coupling with resonators 1 and 4.

It is apparent that direct coupling between resonators 1 and 4 is much smaller than the coupling coefficients of the main signal path, so that direct coupling can be interpreted as a small correction of the signal mostly transmitted on the main signal path.

The trend of the transmission and reflection function as depicted in FIG. 3 is also attainable with the filter structure according to FIG. 1*a*, using the coupling matrix depicted in FIG. 4*b* as a basis. It is apparent that the coupling coefficients of the two main signal paths S, 1, 2, L and S, 3, 4, L have magnitudes of similar order, but in which the product of the coupling coefficients on signal path S, 1, 2, L is positive, but, on the other hand, on signal path S, 3, 4, L it is negative.

FIG. 5 shows a practical embodiment of a filter with the structure depicted in FIG. 1*a*. The input and output S and L are laid out as connection parts 15 and 16 for a rectangular waveguide for transmission of a microwave signal. In one end of the input connection part 15, two iris diaphragms IS1, IS2 are formed, each of which discharges on a cuboid resonator cavity 11 or 13, which embodies the resonator 11 or 13 in FIG. 1*a*. A microwave signal lying at the input connection part 15 thus excites the $H_{101}$ wave type of the resonator cavities 11 and 13. The coupling coefficients between the input and resonators 1 and 3 are established by the configuration of the iris diaphragms IS1 and IS3. In the present case, the iris diaphragms IS1, IS3 extend from a broad side, on which the resonator cavities 11, 12 are opposite, from just above half the height (in the y-direction) of the cavities and in the width direction (x-direction) centered roughly over half their width. Coupling of the two resonators 1, 3 to input S is therefore mostly inductive, which, by convention, can be equated to a coupling coefficient with a positive sign.

In an opposite end of the resonator cavities 11, 12, there are iris diaphragms I12, I34, which discharge on cavities 12, 14, embodying series-connected resonators 2 and 4. The position and configuration of the iris diaphragm I12 corresponds to that of IS1, except for the dimensional differences reflecting the magnitude of the coupling coefficient, so that coupling between resonators 1 and 2 is again inductive; on the other hand, the iris diaphragm I34 is slit-like and extends in the immediate vicinity of a side wall of the resonator cavities 13, 14 over their entire width (in the x-direction) and is capacitive on this account. A negative coupling coefficient between resonators 3, 4 is thus obtained.

Iris diaphragms I2L, I4L, which couple the resonator cavities 12, 14 to the output connection 16, again have the same configuration as the iris diaphragms IS1, IS3. Tunings of resonator frequencies of cavities 11 to 14 that can be required because of different couplings between the resonators are achieved by tuning the widths of the cross sections or other tuning means known from prior art, for example, screws, pins, etc.

Since the two main signal paths S, 1, 2, L and S, 3, 4, L are fully separated from each other between the input and output connection, the corresponding parts of the filter can be developed independently of each other and tuned in production, in order to satisfy the corresponding requirements of the coupling matrix. The connection of both main signal paths at the input S and output L requires only slight corrections, since the interaction between the two is limited. The development and production are therefore reduced to implementation of two partial filters, consisting of the resonators 1, 2 and 3, 4, which is much simpler than the usual development or tuning of a filter with four series-connected resonators, and the sensitivity of the behavior of a finished filter relative to manufacturing scatter also diminishes, since the effects of such scatter in a main signal path are essentially restricted to it, and the second, or optionally other main signal paths that can be present in more complex filter structures than those shown here are not affected detrimentally.

FIG. 6 shows the second practical example of the filter according to the invention with the structure depicted schematically in FIG. 1*a*. A housing 20 encloses an internal space that is divided by a partition 21 arranged in the center with a cross-like layout into four chambers 22 to 25 that form the four resonators 1, 2, 3, 4. In each chamber 22 to 25, a dielectric element 26 is firmly attached to the bottom of the housing via a spacer 27, and a tuning element 28 is mounted movable in the cover of housing 20 opposite dielectric element 26. The resonance frequency of each resonator is essentially determined by the dielectric element 26, in which any necessary fine tuning of the frequency is possible with the corresponding tuning element 28. The spacer 27, like element 26, consists of a dielectric material, but with a much smaller dielectric constant than element 26.

The input and output S, L of the filter are formed by coaxial line sections 30 and 31, whose external conductors 32 are each connected to housing 20, whereas their internal conductor 33 is short-circuited to the partition 21.

The coupling coefficients between the input S, the different resonators 1, 2, 3, 4 and the output L are tunable by means of tuning screw 34, 35. Tuning screws 34, guided through the bottom of housing 20, near internal conductor 23, determine the coupling of input S to the resonators 1, 3.

Screws arranged in the vicinity of output L in a mirror image of screws 34 for tuning of the coupling between resonators 2 and 4 and output L are covered and not visible in the figure. The tuning screws 35, which are inserted into the side walls of housing 20 and, with their tips, lie opposite a transverse plate of the cross-like partition 21, serve for tuning the coupling between resonators 1 and 2 or between 3 and 4.

FIGS. 7*a*, 7*b* show a first modification of the filter from FIG. 6. Elements corresponding to each other are denoted with the same reference numbers. The partition 21 between chambers 22 and 23 or 24 and 25 is enlarged, so that only a circular hole 29 remains as coupling opening between chambers 22, 23 or 24, 25. A metal wire 36 or 37 is passed through each of these holes 29 and connected on its two ends with the opposite surfaces of wall 21. The metal wires 36, 37 each produce a loop coupling between the pairs of chambers operated as $H_{103}$ resonators.

The metal wire 36 is bent into a circle in a horizontal plane, and its two ends resting on wall 21 face each other. The metal wire 37, on the other hand, is bent S-shaped in the same horizontal plane; its two ends are supported on wall 21 on the sides of hole 29 facing away from each other, through which it is guided. If we assume that the wave types excited in chambers 22, 24 are of the same phase, it is easy to comprehend that, because of the different geometries of metal wires 36, 37, magnetic fields with opposite direction or a phase differences of $\pi$ can be excited in chambers 23, 25, i.e., the coupling coefficients between resonators 1, 2, on the one hand, and resonators 3, 4, on the other hand, have opposite signs.

Figure 8B:
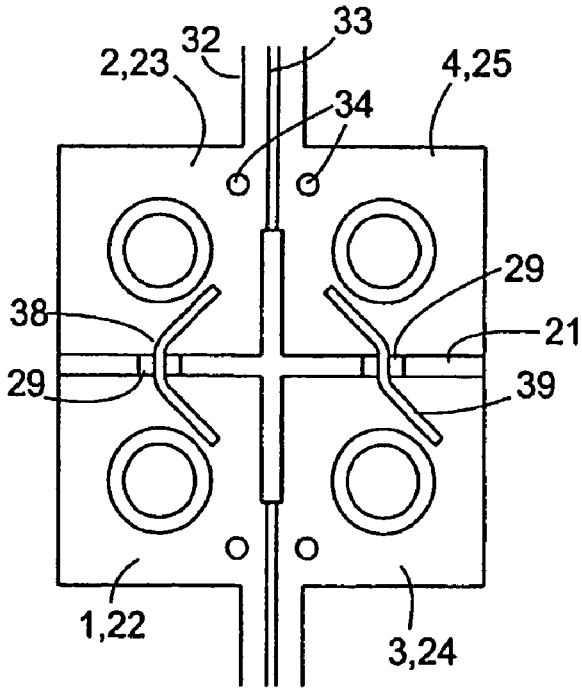

A similar effect is achieved in the variants of FIGS. 9*a*, 9*b*. The partition 21 here is the same as in the variants of FIGS. 8*a*, 8*b*, but a metal wire 38 or 39 running through the holes 29 of partition 21 is not connected on its ends to wall 21, but held in its hole 29 by a dielectric element filling up hole 29 that passes through electromagnetic waves, and its ends freely extend into the chambers.

Whereas in wire 38, both free ends are deflected to the same side in the direction of the longitudinal center plane of the filter, defined by the internal conductor 33, those of the wire 39 are deflected to opposite sides. These two wires 38, 39 assure probe coupling between resonators 1, 2 and 3, 4, each with opposite signs of the coupling coefficients.

FIG. 9 shows a third embodiment of a microwave filter with the structure of FIG. 1*a*. Input S and output L of the filter are formed by rectangular waveguide sections 40, 41 with a height reduced in comparison with the connected waveguide sections 42. The waveguide sections 40, 41 forming the input and output are connected by two pass bands 43, 44. Each of these pass bands 43, 44 includes two resonators 1, 2 or 3, 4, each in the form of a resonator element 45, here cylindrical, galvanically connected and conducting with a bottom of the pass band 43, 44, the elements being excitable to electrical oscillation by a microwave signal lying at input S. The resonance frequency of each resonator element 45 is established by its dimensions and the distance to tuning screws 47 arranged in the upper wall 46 of the filter, opposite it. Tuning screws 47 are shown in FIG. 7 only for the resonator element 45 of pass band 43, but corresponding tuning screws (not shown) are also present for the resonator element 45 of pass band 44.

The pass band 43 between resonator element 45 is free, except for a tip of a tuning screw 48 that extends into the pass band, which serves for tuning the coupling between the two resonators of pass band 43. The pass band 44 is blocked between these two resonator elements 45 on part of its cross section by a partition 49. A tuning screw (not shown) that is arranged in the same manner as the tuning screw 48 depicted for the pass band 43 in wall 46 and is opposite the upper edge of partition 49, permits tuning the coupling coefficient between resonators 3, 4 of pass band 44.

Whereas the coupling between resonators 1, 2 of pass band 43 is inductive in nature, capacitive coupling of resonators 3, 4 is achieved by the partition 49 in pass band 44.

FIG. 10 shows the application of the principle according to the invention to a filter in which resonators 1, 2, 3, 4 are formed by strip conductors 61 to 64 with length $\lambda/2$ structured on a substrate 60 in which $\lambda$ is the wavelength of a signal propagating in the strip conductors in the pass band of the filter.

The strip conductor resonators 61, 62, 63, 64 are coupled to each other and to an input conductor S and an output conductor L, extending parallel and closely adjacent to each other over part of their length. In the main signal path formed by the strip conductors S, 61, 62, L, the strip conductors 61, 62 are arranged so that the signal propagation direction from input S to output L, each shown by arrows, is oriented in the same direction in the sections of the strip conductors connected to each other. In this way, the same sign of the coupling coefficient is obtained for all couplings on a main signal path S, 61, 62, L. In contrast to this, on the main signal path S, 63, 64, L, the sections of the strip conductors 63, 64 connected to each other have oppositely oriented signal propagation directions, so that a coupling coefficient with a negative sign results between these two strip conductors.

Generally, the length of the strip conductor resonators can be $n\lambda/2$, in which n is a small natural number. When n is greater than 1, it is also possible to achieve different signs of the coupling coefficients on the main signal paths to produce couplings between the different half-waves of the standing waves excited in the resonators, similar to the practical example described below with reference to FIGS. 11 and 12.

FIGS. 11 and 12 show another practical example of the filter according to the invention, constructed like the practical example of FIG. 5 from cavity resonators. This filter, shown in a perspective view of FIG. 12, includes only three resonators 2, 3, 4, which form two main signal paths 2, 4 and 3, 4 with a common resonator 4. In the narrow side walls and ends of the resonators 2, 3, 4, as well as the waveguide of the input S and output L, diaphragms IS2, IS, I24, I34, I4L couple the resonators to each other and to the input and output.

FIG. 12 shows the essential field distribution in the resonators in a schematic, sectional view. For the filter function, the H103 wave type is utilized in the cavity resonators 2, 3, 4, shown in each case by magnetic field lines in the resonators running in three closed circles.

The coupling coefficients on the individual iris diaphragms are established by their position relative to the field distribution in the cavities connecting them, as well as their cross section area. The diaphragms IS2, IS3 each couple the left half-wave of input S in the signal propagation direction (from left to right in FIG. 12) to the first half-wave of resonator 2 or 3. The magnetic fields of the first half-waves excited in the resonators therefore have a direction of rotation opposite to the last half-wave of input S, indicated by the arrows drawn on the circles.

The diaphragms I24 and I34 are laid out so that the first half-wave of resonator 4 is coupled essentially to the third half-wave of resonator 3 and the second half-wave of resonator 2, i.e., to half-waves with opposite sign. In this way, coupling coefficients with different sign can be obtained for coupling to diaphragm 134 and to diaphragm 124.

The invention claimed is:

1. A microwave bandpass filter, comprising: a plurality of resonators connected to each other between an input and an output of the filter, the resonators which are connected to the input and the output being directly connected to the input and the output, and at least two main signal paths leading from the input to the output, the at least two main signal paths having overlapping passbands and being connected via different ones of the resonators to the input and the output, the two main signal paths having no common resonators.

2. A microwave bandpass filter, comprising: a plurality of resonators connected to each other between an input and an output of the filter, the resonators which are connected to the input and the output being directly connected to the input and the output, and at least two main signal paths leading from the input to the output, the at least two main signal paths having overlapping passbands and being connected via different ones of the resonators to the input and the output, the at least two main signal paths having overall coupling coefficients with different signs.

* * * * *

UNITED STATES PATENT AND TRADEMARK OFFICE

CERTIFICATE OF CORRECTION

PATENT NO. : 7,317,365 B2
APPLICATION NO. : 10/505716
DATED : January 8, 2008
INVENTOR(S) : Rosenberg et al.

It is certified that error appears in the above-identified patent and that said Letters Patent is hereby corrected as shown below:

On the Title Page Item (74), below "Assistant Examiner" insert Field -- (74) Attorney, Agent, or Firm – Kirschstein et al. --.

In Column 2, Line 62, delete "10" and insert -- 10. --, therefor.

In Column 6, Line 46, delete "IS," and insert -- IS3, --, therefor.

In Column 6, Line 51, delete "H103" and insert -- $H_{103}$ --, therefor.

Signed and Sealed this

Thirtieth Day of December, 2008

JON W. DUDAS
*Director of the United States Patent and Trademark Office*